US009520123B2

(12) United States Patent
Lu et al.

(10) Patent No.: US 9,520,123 B2
(45) Date of Patent: Dec. 13, 2016

(54) SYSTEM AND METHOD FOR PRUNING REDUNDANT UNITS IN A SPEECH SYNTHESIS PROCESS

(71) Applicant: Nuance Communications, Inc., Burlington, MA (US)

(72) Inventors: Heng Lu, Mountain View, CA (US); Xu Shao, Sunnyvale, CA (US); Wei Zhang, Fremont, CA (US); Wenhui Lei, Pudong Shanghai (CN); Andrew Breen, Norfolk (GB)

(73) Assignee: Nuance Communications, Inc., Burlington, MA (US)

( * ) Notice: Subject to any disclaimer, the term of this patent is extended or adjusted under 35 U.S.C. 154(b) by 0 days.

(21) Appl. No.: 14/662,872

(22) Filed: Mar. 19, 2015

(65) Prior Publication Data

US 2016/0275934 A1 Sep. 22, 2016

(51) Int. Cl.
*G10L 13/00* (2006.01)

(52) U.S. Cl.
CPC ..... *G10L 13/00* (2013.01)

(58) Field of Classification Search
CPC ..... G10L 13/00; G10L 13/06; G10L 13/07
USPC ..... 704/258
See application file for complete search history.

(56) References Cited

U.S. PATENT DOCUMENTS 5,913,193 A * 6/1999 Huang ..... G10L 13/07 704/256
6,665,641 B1 * 12/2003 Coorman ..... G10L 13/07 704/258
7,082,396 B1 * 7/2006 Beutnagel ..... G10L 13/07 704/258
2003/0229494 A1 * 12/2003 Rutten ..... G10L 13/06 704/254
2004/0111266 A1 * 6/2004 Coorman ..... G10L 13/07 704/260
2004/0153324 A1 * 8/2004 Phillips ..... G10L 13/04 704/277
2008/0091428 A1 * 4/2008 Bellegarda ..... G10L 13/06 704/254
2009/0319273 A1 * 12/2009 Mitsui ..... G06F 17/30053 704/260
2011/0054903 A1 * 3/2011 Yan ..... G10L 13/08 704/260
2012/0173464 A1 * 7/2012 Tur ..... G06F 9/4446 706/11

(Continued)

OTHER PUBLICATIONS

Zhao et al., "Custom-Tailoring TTS Voice Font—Keeping the Naturalness When Reducing Database Size", EuroSpeech 2003.*

(Continued)

*Primary Examiner* — Jialong He
(74) *Attorney, Agent, or Firm* — Holland & Knight LLP; Mark H. Whittenberger, Esq.

(57) ABSTRACT

A system and method for concatenative speech synthesis is provided. Embodiments may include accessing, using one or more computing devices, a plurality of speech synthesis units from a speech database and determining a similarity between the plurality of speech synthesis units. Embodiments may further include retrieving two or more speech synthesis units having the similarity and pruning at least one of the two or more speech synthesis units based upon, at least in part, the similarity.

14 Claims, 8 Drawing Sheets

(56) References Cited

U.S. PATENT DOCUMENTS

2014/0200894 A1* 7/2014 Osowski ..... G10L 13/08
704/260

OTHER PUBLICATIONS

Kumar, Rohit, and S. Prahallad Kishore. "Automatic pruning of unit selection speech databases for synthesis without loss of naturalness. "Interspeech. 2004.*

Nishizawa, Nobuyuki, and Hisashi Kawai. "Unit database pruning based on the cost degradation criterion for concatenative speech synthesis." Acoustics, Speech and Signal Processing, 2008. ICASSP 2008. IEEE International Conference on. IEEE, 2008.*

Lu, Heng, et al. "Pruning Redundant Synthesis Units Based on Static and Delta Unit Appearance Frequency." Sixteenth Annual Conference of the International Speech Communication Association. 2015.*

Black, Alan W., and Paul A. Taylor. "Automatically clustering similar units for unit selection in speech synthesis." (1997).*

A.W. Black, and P. Taylor, "Automatically clustering similar units for unit selection in speech synthesis," Proc. Eurospeech 1997, Rhodes, Greece, vol. 2, pp. 601-604 (1997) (4 pages).

A. Conkie, K. Syrdal, "Expanding Phonetic Coverage in Unit Selection Synthesis through Unit Substitution from a Donor Voice," Proc. Interspeech 2006, Pittsburgh, Pennsylvania, pp. 1754-1757 (Sep. 17-21, 2006) (4 pages).

H. Lu, S. King, "Using Bayesian Networks to find relevant context features for HMM-based speech synthesis," Proc. Interspeech 2012 (2012) (4 pages).

A. J. Hunt, A.W. Black, "Unit selection in a concatenative speech synthesis system using a large speech database," Proc. ICASSP 1996, IEEE, pp. 373-376 (1996) (4 pages).

P. Rutten, M. Aylett, J. Fackrell, and P. Taylor, "A statistically motivated database pruning technique for unit selection synthesis," Proc. International Conference on Spoken Language Processing, Denver, Colorado, pp. 125-128 (Sep. 16-20, 2002) (4 pages).

M. Beutnagel, A. Conkie, J. Schroeter, Y. Stylianou, and A. Syrdal, "The AT&T NextGen TTS System," Joint Meeting of ASA, EAA amd DAGA (1999) (4 pages).

S. Kim,Y. Lee, and K. Hisose, "Pruning of Redundant Synthesis Instances Based on Weighted Vector Quantization," Proc. Eurospeech 2001, vol. 3, pp. 2231-2234, (2001) (4 pages).

P. Tsiakoulis, A. Chalamandaris, S. Karabetsos, S. Raptis, "A Statistical Method for Database Reduction for Embedded Unit Selection Speech Synthesis," Proc. ICASSP 2008, Las Vegas, USA, pp. 4601-4604, (2008) (4 pages).

V. Karaiskos, S. King, R. A. J. Clark, and C. Mayo, "The Blizzard Challenge 2008," Blizzard Challenge Workshop, (2008) (18 pages).

S. King, V. Karaiskos, "The Blizzard Challenge 2009," Blizzard Challenge Workshop (2009) (24 pages).

Z. Ling, H. Lu, G. Hu, L. Dai, R. Wang, "The USTC System for Blizzard Challenge 2008," Blizzard Challenge Workshop (2008) (6 pages).

H. Lu, Z. Ling, M. Lei, C. C. Wang, H. H. Zhao, L. H. Chen, L. R. Dai, R. H. Wang, "The USTC system for Blizzard Challenge 2009," Blizzard Challenge Workshop (2009) (6 pages).

* cited by examiner

300

500

600

700

750

SYSTEM AND METHOD FOR PRUNING REDUNDANT UNITS IN A SPEECH SYNTHESIS PROCESS

TECHNICAL FIELD

This disclosure relates generally to a method for speech synthesis, and more particularly, to a method for pruning redundant units in a speech synthesis system.

BACKGROUND

The synthesis voice quality for concatenative speech synthesis systems depends on the coverage of speech units in training the speech database under various contexts. Experiments and evaluations have shown that concatenative Text-to-Speech (TTS) systems with large training datasets outperform TTS systems with small training datasets. However, a large speech database can make the footprint of the TTS system too large to be installed on embedded systems like mobile phones or automobiles. In current implementations, the size of server or cloud-based TTS systems can even reach 1 GB, while for embedded TTS systems, the maximum footprint allowed is around 300 MB.

Conventionally, there are two categories of redundant unit pruning approaches for TTS systems. One is referred to as bottom-up, in which case redundant units are purely measured and pruned just by investigating the database itself. Here, the similarity of units is calculated by objective measures which are independent of the unit-selection strategy. There is a drawback to this approach: the units regarded and retained as "similar" and "representative" during unit pruning are not guaranteed to be chosen as replacements for those pruned units in the speech synthesis process. Even in subjective perception they sound similar to each other. That is simply because the criterion for unit reduction is unrelated to the criterion for unit-selection.

The other approach is referred to as up-bottom. In this method, units are pruned based on the analytical results of unit-selection by the TTS system. Redundant units are pruned based on unit appearance frequency ("UAF"), which indicates the unit selection frequency in massive synthesis. The unit appearance frequency (UAF) is generated from the statistical results of massive synthesis on a huge amount of test text scripts. High UAF indicates the unit is frequently selected in the synthesis process, while low UAF means the unit is chosen less often. This method prunes away units with lower UAF.

SUMMARY OF DISCLOSURE

In one implementation, a method for concatenative speech synthesis is provided. The method may include accessing, using one or more computing devices, a plurality of speech synthesis units from a speech database and determining a similarity between the plurality of speech synthesis units. The method may further include retrieving two or more speech synthesis units having the similarity and pruning at least one of the two or more speech synthesis units based upon, at least in part, the similarity.

One or more of the following features may be included. In some embodiments, pruning may be based upon, at least in part, a delta unit appearance frequency technique. Pruning may also be based upon, at least in part, a delta unit appearance frequency technique and a unit appearance frequency technique. In some embodiments, determining a similarity may be based upon, at least in part, a similarity factor. The method may further include receiving a text input corresponding to an utterance during a massive synthesis phase associated with the concatenative speech synthesis. The method may also include determining a unit set based upon, at least in part, the utterance and providing the unit set as feedback prior to pruning.

In another implementation, a non-transitory computer-readable storage medium is provided. The non-transitory computer-readable storage medium may have stored thereon instructions, which when executed by a processor result in one or more concatenative speech synthesis operations. The operations may include accessing, using one or more computing devices, a plurality of speech synthesis units from a speech database and determining a similarity between the plurality of speech synthesis units. Operations may further include retrieving two or more speech synthesis units having the similarity and pruning at least one of the two or more speech synthesis units based upon, at least in part, the similarity.

One or more of the following features may be included. In some embodiments, pruning may be based upon, at least in part, a delta unit appearance frequency technique. Pruning may also be based upon, at least in part, a delta unit appearance frequency technique and a unit appearance frequency technique. In some embodiments, determining a similarity may be based upon, at least in part, a similarity factor. Operations may further include receiving a text input corresponding to an utterance during a massive synthesis phase associated with the concatenative speech synthesis. Operations may also include determining a unit set based upon, at least in part, the utterance and providing the unit set as feedback prior to pruning.

In another implementation, a system configured to perform concatenative speech synthesis is provided. The system may include one or more processors configured to access a plurality of speech synthesis units from a speech database and determine a similarity between the plurality of speech synthesis units. The one or more processors may be further configured to retrieve two or more speech synthesis units having the similarity. The one or more processors may be further configured to prune at least one of the two or more speech synthesis units based upon, at least in part, the similarity.

One or more of the following features may be included. In some embodiments, pruning may be based upon, at least in part, a delta unit appearance frequency technique. Pruning may also be based upon, at least in part, a delta unit appearance frequency technique and a unit appearance frequency technique. In some embodiments, determining a similarity may be based upon, at least in part, a similarity factor. The one or more processors may be further configured to receive a text input corresponding to an utterance during a massive synthesis phase associated with the concatenative speech synthesis. The one or more processors may be further configured to determine a unit set based upon, at least in part, the utterance and providing the unit set as feedback prior to pruning.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings may indicate like elements.

DETAILED DESCRIPTION

Embodiments provided herein are directed towards a system and method for pruning redundant units in a speech synthesis process. As discussed above, existing approaches for pruning redundant units focus on either bottom-up or up-bottom techniques. In contrast, embodiments of the pruning process described herein may be used to reduce the footprint of concatenative speech synthesis systems for embedded devices by utilizing a delta unit appearance frequency which indicates whether a unit is replaceable or not, which may be used in addition to a unit appearance frequency (UAF)-based pruning criterion. Accordingly, the pruning process included herein may use both static and delta unit appearance frequency as pruning criteria. In this way, only units having a comparatively high appearance frequency and which cannot be replaced by other units may be preserved in the database. Experiments show that the new method can reduce the footprint of a speech synthesis system greatly without losing much synthesis voice quality.

Figure 1:
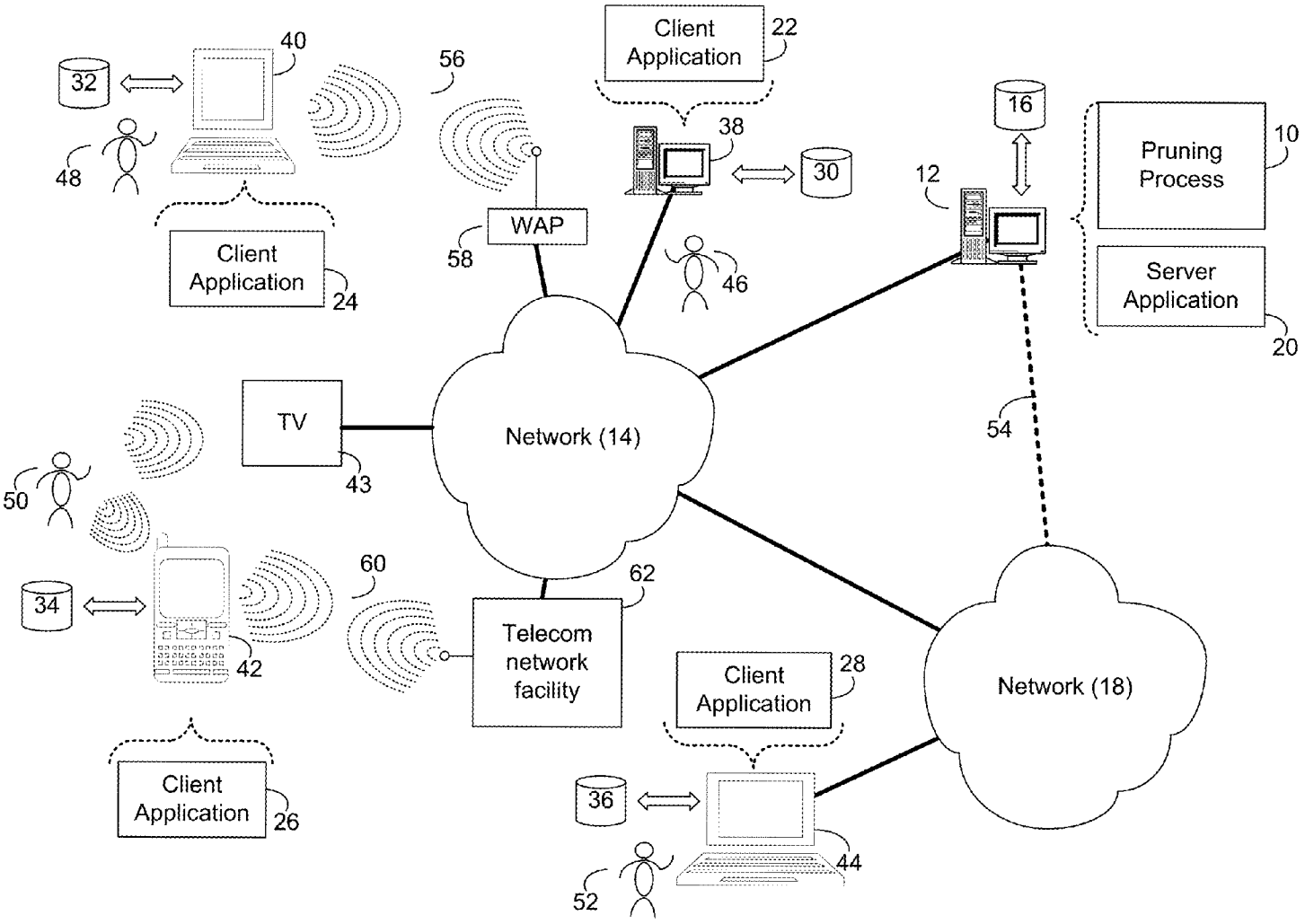
FIG. 1 is a diagrammatic view of a system configured to implement a pruning process in accordance with an embodiment of the present disclosure.
Figure 2:
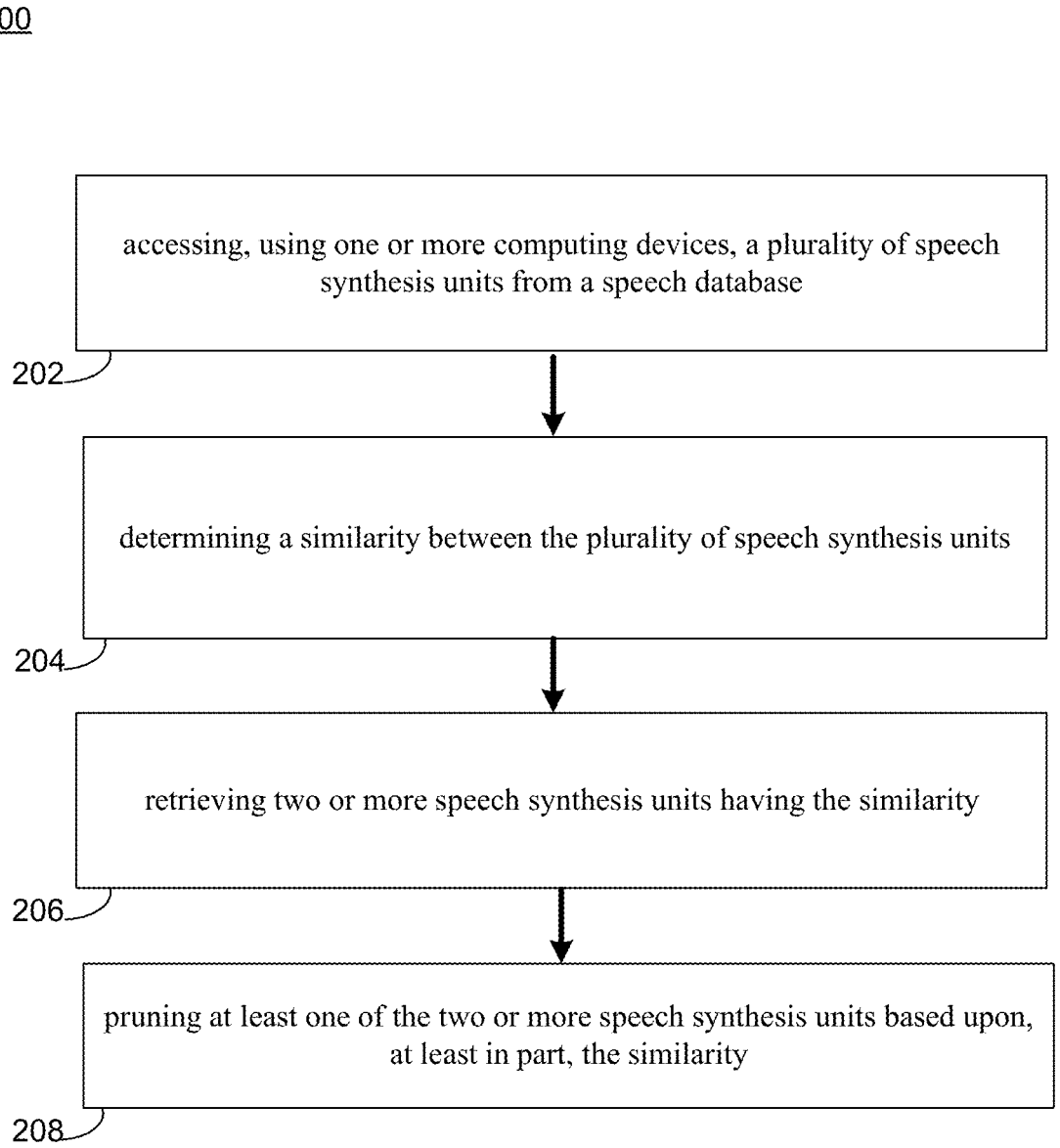
FIG. 2 is a flowchart of a pruning process in accordance with an embodiment of the present disclosure.

Referring to FIG. 1, there is shown a pruning process 10 that may reside on and may be executed by computer 12, which may be connected to network 14 (e.g., the Internet or a local area network). Server application 20 may include some or all of the elements of pruning process 10 described herein. Examples of computer 12 may include but are not limited to a single server computer, a series of server computers, a single personal computer, a series of personal computers, a mini computer, a mainframe computer, an electronic mail server, a social network server, a text message server, a photo server, a multiprocessor computer, one or more virtual machines running on a computing cloud, and/or a distributed system. The various components of computer 12 may execute one or more operating systems, examples of which may include but are not limited to: Microsoft Windows Server™; Novell Netware™; Redhat Linux™, Unix, or a custom operating system, for example.

As will be discussed below in greater detail in FIGS. 2-8, pruning process 10 may include accessing (202), using one or more computing devices, a plurality of speech synthesis units from a speech database and determining (204) a similarity between the plurality of speech synthesis units. Embodiments may further include retrieving (206) two or more speech synthesis units having the similarity and pruning (208) at least one of the two or more speech synthesis units based upon, at least in part, the similarity.

The instruction sets and subroutines of pruning process 10, which may be stored on storage device 16 coupled to computer 12, may be executed by one or more processors (not shown) and one or more memory architectures (not shown) included within computer 12. Storage device 16 may include but is not limited to: a hard disk drive; a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

In some embodiments, pruning process 10 may be accessed and/or activated via client applications 22, 24, 26, 28. Examples of client applications 22, 24, 26, 28 may include but are not limited to a standard web browser, a customized web browser, or a custom application that can display data to a user. The instruction sets and subroutines of client applications 22, 24, 26, 28, which may be stored on storage devices 30, 32, 34, 36 (respectively) coupled to client electronic devices 38, 40, 42, 44 (respectively), may be executed by one or more processors (not shown) and one or more memory architectures (not shown) incorporated into client electronic devices 38, 40, 42, 44 (respectively).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, personal computer 38, laptop computer 40, smart phone 42, television 43, notebook computer 44, a server (not shown), a data-enabled, cellular telephone (not shown), a dedicated network device (not shown), an audio recording device, etc.

One or more of client applications 22, 24, 26, 28 may be configured to effectuate some or all of the functionality of pruning process 10. Accordingly, pruning process 10 may be a purely server-side application, a purely client-side application, or a hybrid server-side/client-side application that is cooperatively executed by one or more of client applications 22, 24, 26, 28 and pruning process 10.

Client electronic devices 38, 40, 42, 44 may each execute an operating system, examples of which may include but are not limited to Apple iOS™, Microsoft Windows™, Android™, Redhat Linux™, or a custom operating system. In some cases, the client electronic device may include audio recording functionality and/or may be an audio recording device. Additionally and/or alternatively, in some embodiments an audio recording device may be in communication with one or more of the client electronic devices as is discussed in further detail herein.

Users 46, 48, 50, 52 may access computer 12 and pruning process 10 directly through network 14 or through secondary network 18. Further, computer 12 may be connected to network 14 through secondary network 18, as illustrated with phantom link line 54. In some embodiments, users may access pruning process 10 through one or more telecommunications network facilities 62.

The various client electronic devices may be directly or indirectly coupled to network 14 (or network 18). For example, personal computer 38 is shown directly coupled to network 14 via a hardwired network connection. Further, notebook computer 44 is shown directly coupled to network 18 via a hardwired network connection. Laptop computer 40 is shown wirelessly coupled to network 14 via wireless communication channel 56 established between laptop computer 40 and wireless access point (i.e., WAP) 58, which is shown directly coupled to network 14. WAP 58 may be, for example, an IEEE 802.11a, 802.11b, 802.11g, Wi-Fi, and/or Bluetooth device that is capable of establishing wireless communication channel 56 between laptop computer 40 and WAP 58. All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and smart phones to be interconnected using a short-range wireless connection.

Smart phone 42 is shown wirelessly coupled to network 14 via wireless communication channel 60 established between smart phone 42 and telecommunications network facility 62, which is shown directly coupled to network 14. In some embodiments, smartphone 42 may be an audio recording device or may include audio recording functionality and may enable an end user to record a speech signal. The speech signal may be stored and/or transmitted to any of the devices described herein. For example, transmitted over network 14 to client electronic device 40.

The phrase "telecommunications network facility", as used herein, may refer to a facility configured to transmit, and/or receive transmissions to/from one or more mobile devices (e.g. cellphones, etc). In the example shown in FIG. 1, telecommunications network facility 62 may allow for communication between any of the computing devices shown in FIG. 1 (e.g., between cellphone 42 and server computing device 12).

Embodiments of pruning process 10 may be used in any suitable environment. Some of these may include but are not limited to, embedded systems, intelligent car systems, car navigation systems, cell phones, intelligent house furnishings, intelligent watches, intelligent wearable devices, clothing, etc.

There are drawbacks to methods based on only UAF. Pruning only based on UAF may keep many redundant or overly similar units which are actually interchangeable in the synthesis process. On the contrary, representative but less frequently selected units are pruned away due to the high UAF threshold. Accordingly, for low-frequency phonetic contexts, no suitable units may be available during synthesis.

Figure 3:
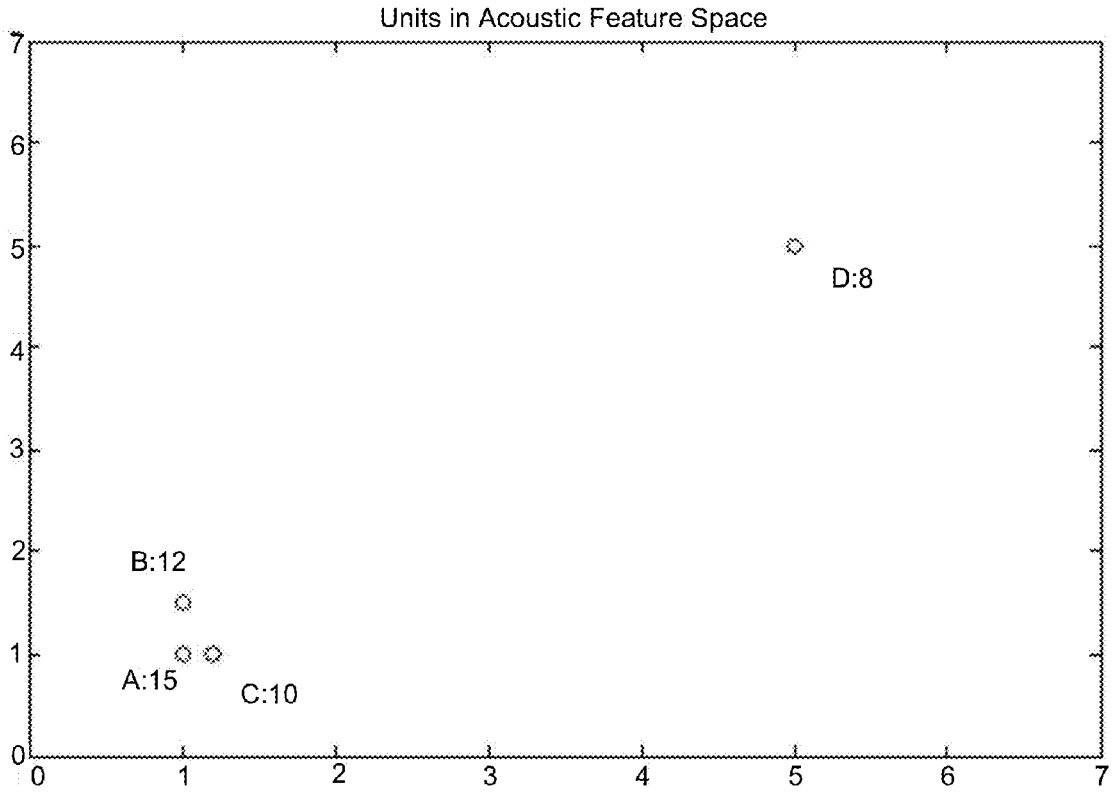
FIG. 3 is a diagrammatic view of an example for unit pruning.

Referring now to FIG. 3, an example illustrates unit pruning is provided. In this particular example, units A, B, C and D are plotted in a simplified acoustic feature space, assuming the UAF of A is 15, B 12, C 10 and D 8. If we set the UAF pruning threshold to 9, then units A, B and C may be kept in the corpus and unit D may be removed. In actual cases, it may be desirable to keep D and prune B and C if A can replace them. This is because D may be very representative in the acoustic feature space while units A, B and C are very similar to each other.

In some cases, UAF is multiplied by some scores to serve as unit pruning criterion, which can vary greatly according to the different dynamic range of UAF and the score assigned by the unit-selection system.

Accordingly, embodiments of pruning process 10 may include this type of feedback mechanism (e.g. similar to an up-bottom-up method). In this way, pruning process 10 may take advantage of UAF, and solve the drawback mentioned above. In pruning process 10, both unit similarity and appearance frequency may be considered as unit pruning criteria. As such, in some cases, only units with comparatively high appearance frequency and which are irreplaceable by other units may be stored in the database. Unit target cost in the unit-selection process may be directly used in the unit pruning stage as a similarity measure. Additionally and/or alternatively, instead of using only UAF, or UAF multiplied by some score, as the unit pruning criterion, pruning process 10 may utilize the concept of a delta unit appearance frequency ("DUAF"), which is based on unit similarity measures and may be used along with conventional static unit frequency in the pruning process.

Figure 4:
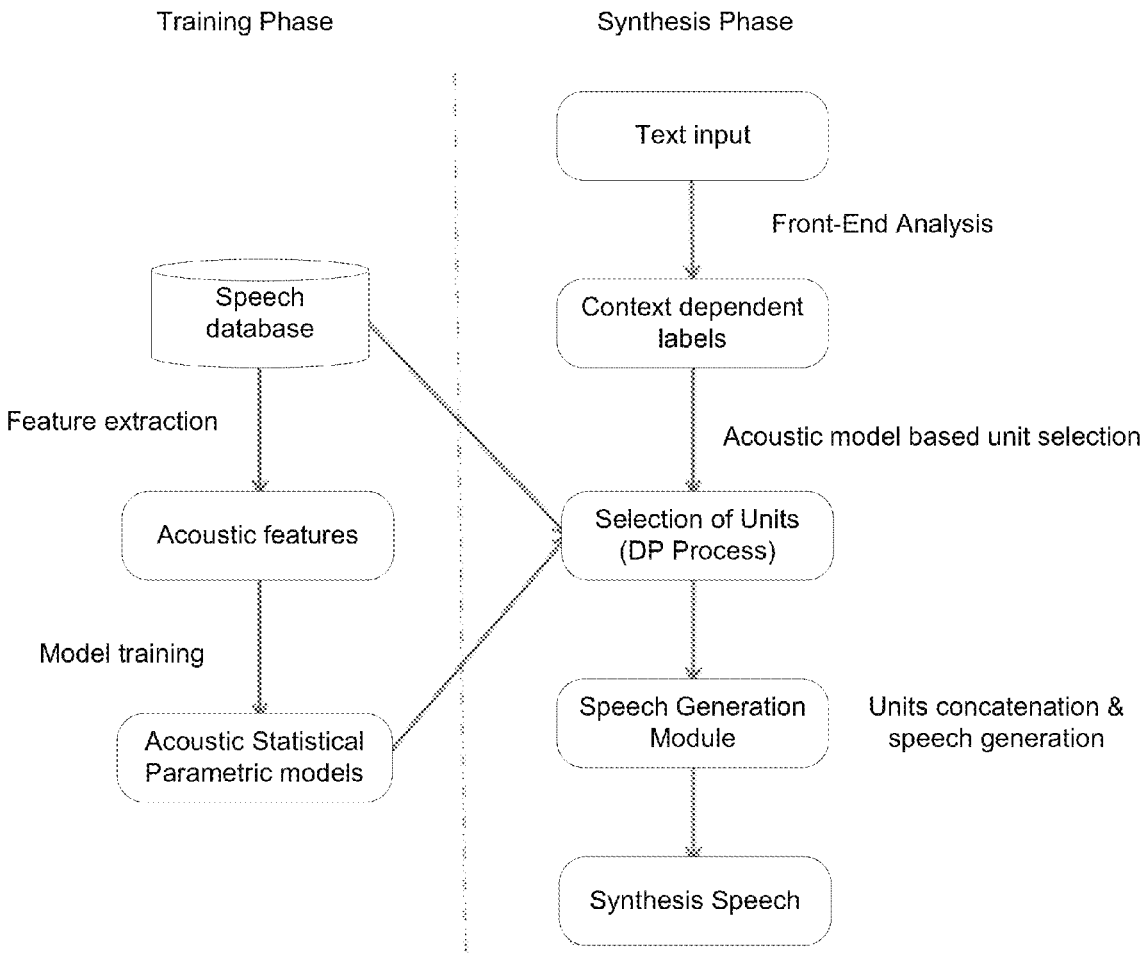
FIG. 4 is a diagrammatic view of an example of an pruning process in accordance with an embodiment of the present disclosure.

Referring now to FIG. 4, a diagram 400 consistent with an embodiments of pruning process 10 is provided. More specifically, diagram 400 depicts an example showing unit-selection and concatenation TTS. Diagram 400 shows the two primary phases in a typical TTS system, which may be located at any suitable position within networks 14 and 18 (e.g., partially or entirely within server computing device 12 and storage device 16). These phases include both the training phase and the synthesis phase. In the training phase, acoustic and symbolic features may be extracted from the speech database. These features may be used to train a number of models for real-time synthesis. In the synthesis phase, the raw texts may be first analyzed by a front-end component into context-dependent labels that the back-end component can interpret. Unit selection may occur in the back-end synthesis phase. In this stage, corresponding acoustic statistical parametric models may be first searched according to the context labels generated in the previous stage. Then these models may be used as a target to conduct a dynamic programming ("DP") process to select the most suitable unit sequence from the speech database. Finally, selected units may be concatenated and sent to a speech generation module in order to synthesize speech.

Figure 5:
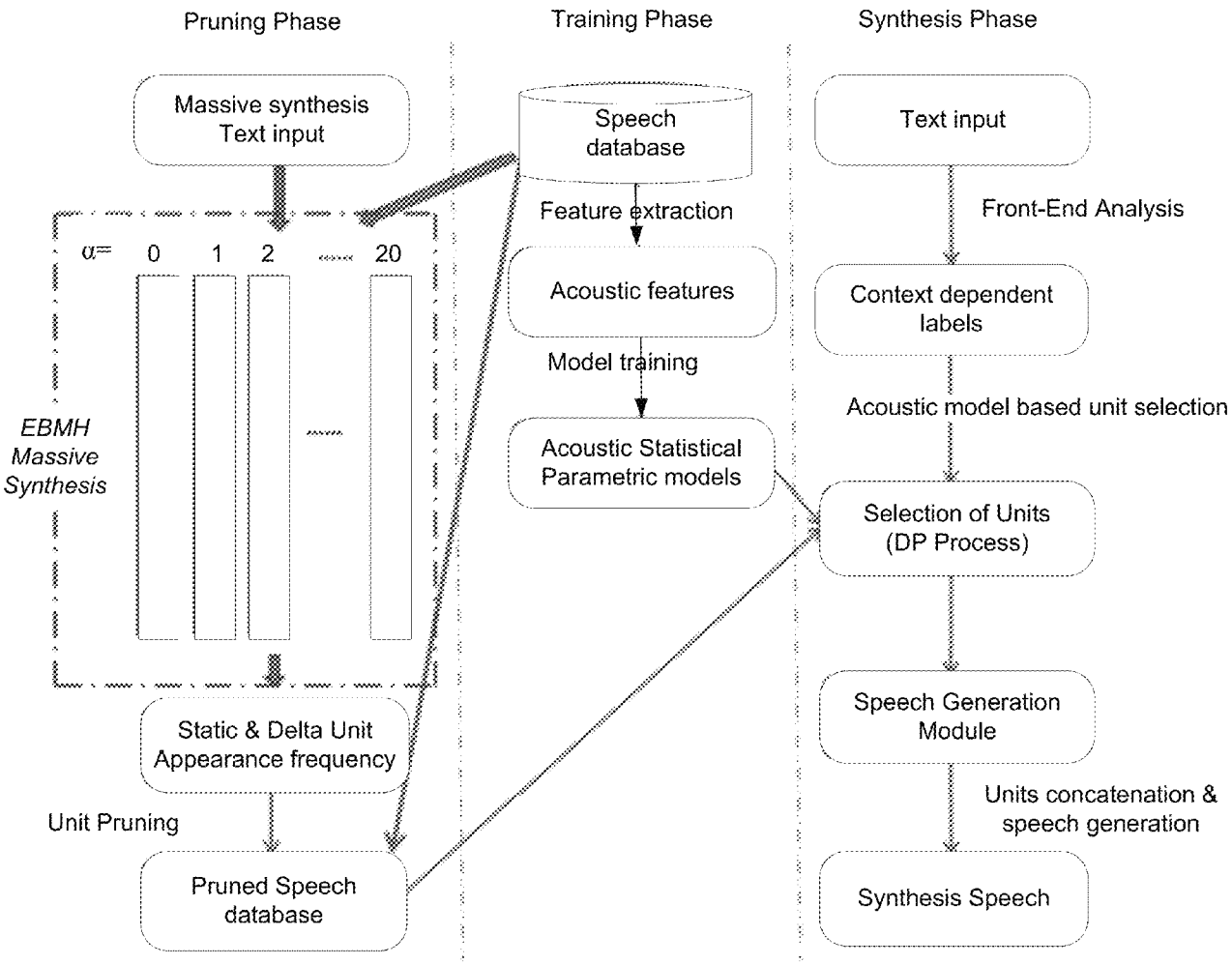
FIG. 5 is a diagrammatic view of an example of a pruning process in accordance with an embodiment of the present disclosure.

Referring now to FIG. 5, a diagram 500 consistent with embodiments of pruning process 10 is provided. More specifically, diagram 500 includes the unit pruning phase in the diagram of the broader TTS system structure. As is shown in FIG. 5, embodiments of pruning process 10 may be configured to run parallel streams of massive synthesis with different settings of the unit selection cost award a. Based on the statistical results from massive synthesis, the conventional static unit appearance frequency (UAF) may be calculated, as well as the Delta Unit Appearance Frequencies (DUAF) for different a. At last, the optimal a is chosen according to human listening preference, and the thresholds for both static and delta unit appearance may be set to prune the original database. As a result, only the pruned speech database may be needed at run-time synthesis, which greatly reduces the footprint of the entire TTS system. Addition detail regarding pruning process 10 is provided in further detail hereinbelow.

Embodiments of pruning process 10 may incorporate a unit-selection cost award approach. Accordingly, pruning process 10 may be configured to consider both unit appearance frequency and the similarity between units. The goal is to remove the less frequently used and overly similar units to meet the footprint requirements of embedded systems. In order to avoid the inconsistency between the unit pruning and selection criteria, pruning process 10 may utilize a measurement to judge unit similarity, based on unit cost in the selection process. Accordingly, this cost may be employed as a criterion for measuring similarity between two units. For example, two units with the same or nearly the same cost may replace each other in the unit-selection process, which may not make much difference in the resulting synthesis quality, regardless how different the two units are in the other measures.

Equation 1 shows the DP (Dynamic Programming) process for the conventional unit-selection TTS system:

$$S = \{\hat{s}_1, \hat{s}_2, \ldots, \hat{s}_N\} = \underset{S}{\operatorname{argmin}}\left(\sum_{i=1}^{N} C(s_i)\right) \quad (1)$$

$$s_i \in U_i$$

Here, S is the optimum unit sequence chosen by the unit selection system. si is the ith chosen unit. N is the total number of basic units in the current utterance. C(si) is the cost of the ith basic unit, including both target cost and concatenation cost. Ui is the total number of candidate units that si can choose from at the basic unit position i.

In order to measure the similarity between units and conduct pruning, the DP process and cost calculation function in unit-selection may be redefined as:

$$S = \{\hat{s}_1, \hat{s}_2, \ldots, \hat{s}_N\} = \underset{S}{\operatorname{argmin}}\left(\sum_{i=1}^{N} (C(s_i) - f(s_i) \times \alpha)\right) \quad (2)$$

$$s_i \in U_i$$

Here, f(si) is an indicator function to indicate whether the current candidate, si, has been selected during the previous massive synthesis, defined as follows.

$$f(s_i) = \begin{cases} 1 & \text{if } s_i \in A \\ 0 & \text{if } s_i \notin A \end{cases}$$

Where A is the unit set that was previously selected in massive synthesis. α is an award factor or similarity factor added to the basic unit selection cost function.

Accordingly, pruning process 10 may encourage the selected unit to be chosen again, and to replace similar units according to the award factor α. Any unit within the same range of the award factor α as the previously selected similar unit is unlikely to be selected.

Figure 6:
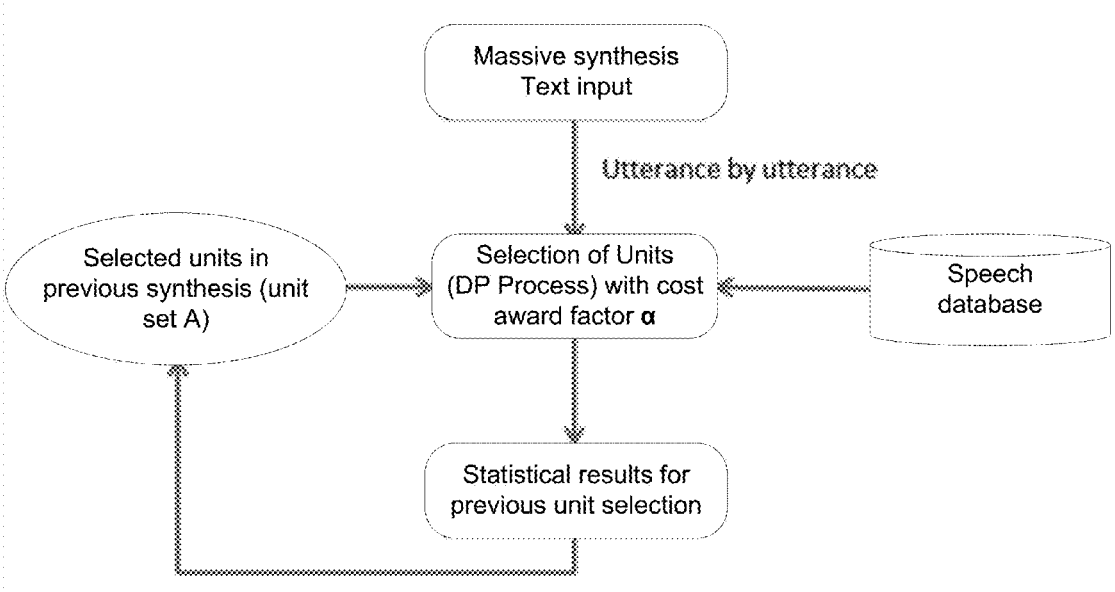
FIG. 6 is a diagrammatic view of an example of a pruning process in accordance with an embodiment of the present disclosure.

Referring now to FIG. 6, a diagram 600 consistent with embodiments of pruning process 10 is provided. More specifically, diagram 600 depicts an example showing the integration of the award factor with a massive synthesis method in unit-pruning. Accordingly, FIG. 6 shows the integration of award factor α with the massive synthesis module in hashed lines in FIG. 5. Compared with the conventional massive synthesis process, pruning process 10 includes a feedback mechanism. As can be seen clearly from FIG. 6, for each utterance input during massive synthesis, each unit's usage may be recorded according to the selection results. The statistical result may be recorded as unit set A, which may be fed into the unit-selection DP process for the following synthesis process.

In some embodiments, pruning process 10 may include a delta unit appearance frequency methodology. As discussed above, the traditional unit-reduction method utilizes UAF as the criterion to determine whether a unit is redundant or not, an approach that has a number of drawbacks. An award factor, a, has been introduced to encourage the chosen units from being re-selected again.

Table (1) shows the UAF in massive synthesis when α=0 and α=20 for some units as examples.

TABLE 1

| Unit ID | UAF (α = 0) | UAF (α = 20) |
|---|---|---|
| 428842 | 9 | 15 |
| 428843 | 9 | 15 |
| 428844 | 5 | 5 |
| 428845 | 5 | 5 |
| 428846 | 3 | 5 |
| 428847 | 8 | 12 |
| 428848 | 8 | 8 |
| 428849 | 6 | 6 |
| 428850 | 2 | 0 |
| 428851 | 2 | 0 |
| 428852 | 1 | 1 |
| 428853 | 1 | 1 |
| 428854 | 10 | 0 |
| 428855 | 0 | 0 |

The α=0 is actually the same as in the traditional UAF method. When the award factor α=20, the UAF changes along with the award factor. The award factor can make some unit appearance frequencies higher, such as unit 428843 etc., which indicates that they may replace other "similar" units. Meanwhile, some units, such as unit 428854, are selected less often, which indicates that they are more likely to be replaced by the other more "representative" units.

In some embodiments, pruning process 10 may incorporate a delta unit appearance frequency (DUAF), which may include the change of UAF along with the award factor α. The DUAF is defined in Equation 3 provided below:

$$UAF = a_0$$

$$DUAF = a_0 - a_i \quad (3)$$

Where ai is the UAF when the award factor α=i. a0 is the conventional static UAF. DUAF changes along with different award factor settings. The DUAF may be employed together with the UAF as criteria in further unit reduction processes.

Test results incorporating pruning process 10 for massive synthesis are set forth below. A set of award factors α=[0; 0:5; 1; 1:5; 2; 5; 7; 10; 15; 20] were selected and added to the cost function in the massive synthesis process for comparison purposes. A total of 51832 test utterances from People's Daily Newspaper, Sina News, etc., were synthesised in massive synthesis. Both UAF and DUAF were included in the pruning criteria. Two MOS tests were carried out, with two goals in mind. The first goal was to test how human subjective perception correlates with different a with similar numbers of remaining units. The second goal is to further prune the redundant units with fixed value of a0 while minimizing negative impacts on quality.

In MOS test 1, all systems were pruned to the similar size (see Table 2). Five speech synthesis systems were compared for voice quality between the proposed method and the conventional unit frequency based method, all with the similar footprints.

TABLE 2

| Pruning criteria by system | Total units remaining |
|---|---|
| A: $\alpha_0 \geq 7$ | 55256 |
| B: $\alpha_0 \geq 5.5$ and $(\alpha_0-\alpha_2) \leq 0$ | 55869 |
| C: $\alpha_0 \geq 4.7$ and $(\alpha_0-\alpha_5) \leq 0$ | 55441 |
| D: $\alpha_0 > 4$ and $(\alpha_0-\alpha_{10}) \leq 0$ | 55084 |
| E: $\alpha_0 \geq 3.5$ and $(\alpha_0-\alpha_{20}) \leq 0$ | 55574 |

In test 1, 36 utterances in "General", "News", "Navigation", "Voice Assistant", "Email reading" and "Website reading" domains were used. Each test sentence was listened to 25 times by native speakers. The speech database without any pruning had a total of 206902 units. System A prunes units using UAF only, with a0≥7, and the unit count remains is 55256. System B employs both UAF and DUAF with a0≥5:5 and (a0−a2)≤0. These conditions mean that units matched with following conditions are kept: (i) UAF is no less than 5.5; and (ii) the unit can not be replaced by other units when the factor value equals 2. The same settings with different values are applied to system C as to system D. The a0 threshold value may be tuned to make sure the systems have similar size.

Figure 7:
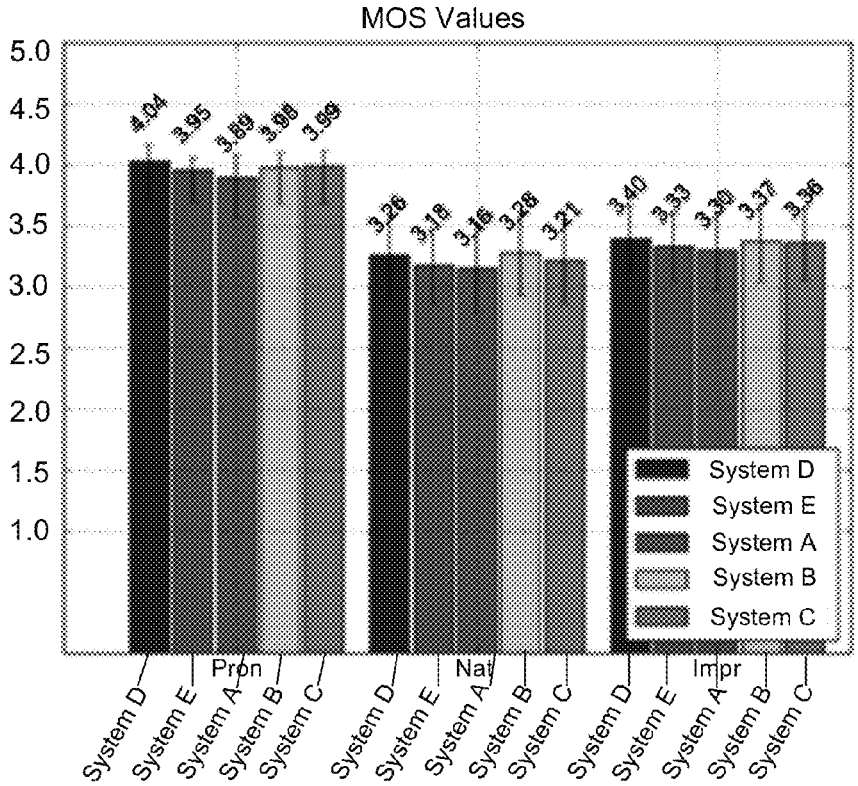
FIG. 7 is a diagrammatic view of results generated from a pruning process in accordance with an embodiment of the present disclosure.
Figure 7:
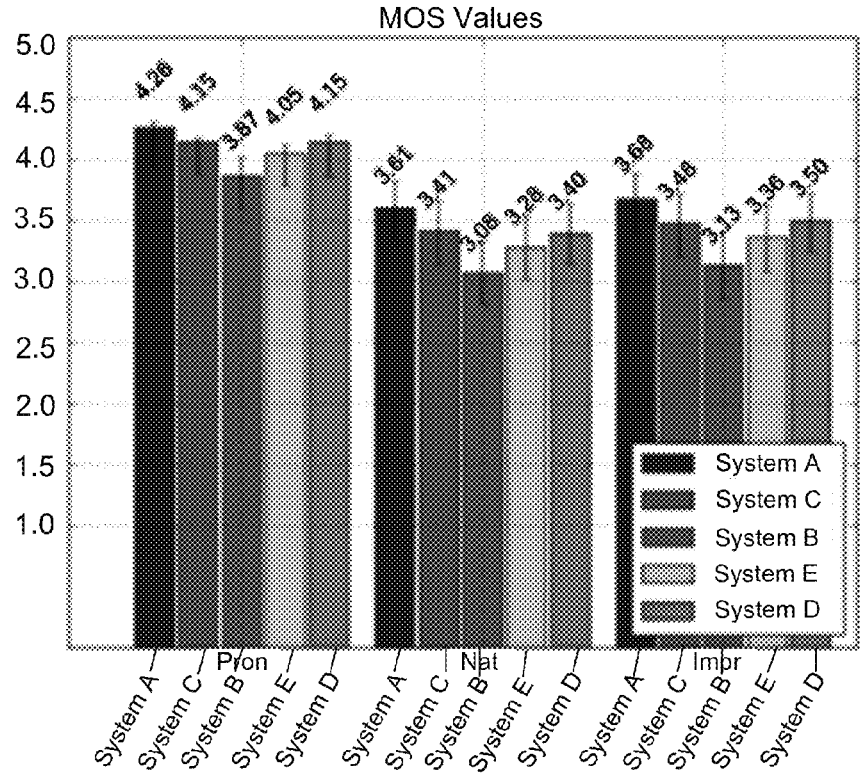

The MOS evaluation results are shown in FIG. 7. Pruning process 10, including both static and delta unit appearance frequency, out-performs the conventional method using only static UAF. The conventional method (A) has the lowest MOS score among all five systems. This proves the effectiveness of pruning process 10. It also can be noticed that a very large award factor such as $\alpha$=20 makes many units no longer "similar" and therefore not interchangeable in the synthesis process, as in system E, which shows degraded voice quality. Systems D and B show very similar performance. Both $\alpha$=2 and $\alpha$=10 were used further in the following experiments.

MOS test 2 aims to find the smallest unit count that a system can retain without a detrimental impact on voice quality. Five speech synthesis systems were built after pruning using different unit pruning criteria, as shown in Table 3.

TABLE 3

| Pruning criteria by system | Total units remaining |
|---|---|
| A: Baseline | 206902 |
| B: Random unit pruning to 56902 units | 56902 |
| C: $\alpha_0 \geq 7$ | 55256 |
| D: $\alpha_0 \geq 7$ and $(\alpha_0-\alpha_2) \leq 0$ | 45390 |
| E: $\alpha_0 \geq 7$ and $(\alpha_0-\alpha_{10}) \leq 0$ | 39169 |

System A is the baseline, without any pruning, and has a total of 206902 units. System B is the randomly pruned system where only 56902 (27.5%) units are kept. System C prunes using only UAF, with a0≥7 to keep about the same amount of units as in system B. System D employs both UAF and DUAF. Units with both a0≥7 and (a0−a2)≤0 are retained in the database. These settings can be interpreted in the same way as in the previous experiment. Similarly, System E has criteria a0≥7 and (a0−a10)≤0, where the award factor value is 10.

It can be observed from FIG. 7 (shown as diagram 750) that: (i) The random unit pruning (system B) has the worst performance; (ii) The conventional unit frequency based pruning method (system C) almost has the same quality as system D has. However, system D has nearly 10000 fewer units (about 17:86% less) than system C; (iii) If the cost award is increased from 2 (system D) to 10 (system E), the remaining unit count can be further reduced. However, the voice quality then decreases unacceptably.

Embodiments of pruning process 10 may be used for reducing corpus size for unit-selection TTS systems. The evidence shows that this method out-performs the conventional unit pruning method. The new concepts unit cost award factor and delta unit appearance frequency are defined. Pruning process 10 may be used to effectively reduce the size of current unit-selection systems by 79.1% to meet to requirement of mobile devices, resulting in a MOS score drop of only 0.18. It should be noted that pruning process 10 may be applied to any suitable system, including, but not limited to, concatenation TTS systems.

During the massive synthesis process, it is always impossible for massive synthesis text to exhaust all phonetic combination under different context. Therefore, this process will always introduce bias. In that event, it may not be sufficient to count only on static unit frequency for unit pruning A unit that may be less frequently selected only because there are too few instances of its phonetic context in the input scripts during massive synthesis. To reduce the huge importance of static unit appearance frequency, delta unit appearance frequency is therefore included among the pruning criteria. A unit remains only if: (i) it appears relatively frequently (static frequency); and (ii) it can't be replaced by the other "similar" units (delta frequency).

Figure 8:
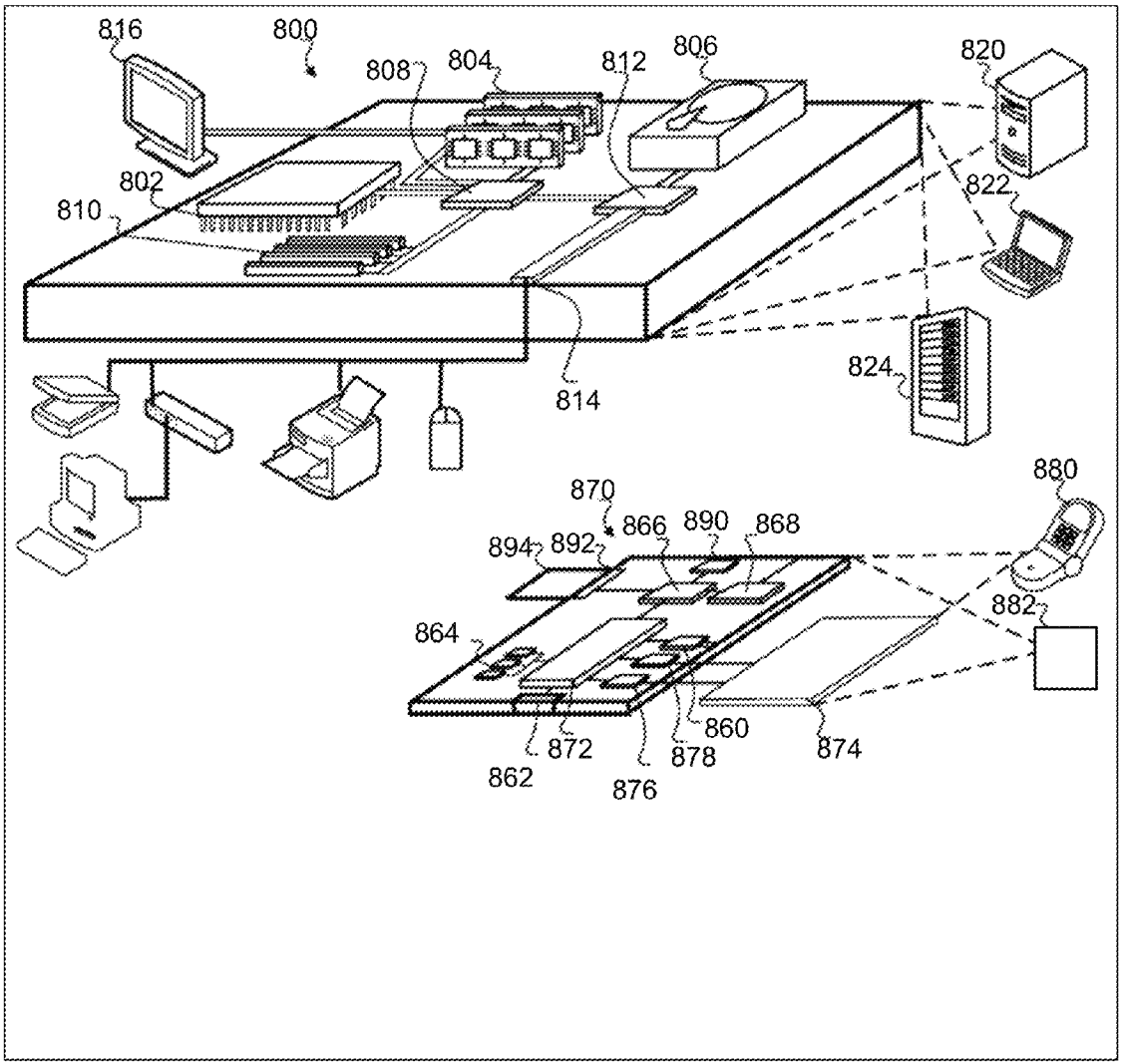
FIG. 8 shows an example of a computer device and a mobile computer device that can be used in accordance with the pruning process described herein.

Referring now to FIG. 8, an example of a generic computer device 800 and a generic mobile computer device 870, which may be used with the techniques described here is provided. Computing device 800 is intended to represent various forms of digital computers, such as tablet computers, laptops, desktops, workstations, personal digital assistants, servers, blade servers, mainframes, and other appropriate computers. In some embodiments, computing device 870 can include various forms of mobile devices, such as personal digital assistants, cellular telephones, smartphones, and other similar computing devices. Computing device 870 and/or computing device 800 may also include other devices, such as televisions with one or more processors embedded therein or attached thereto. The components shown here, their connections and relationships, and their functions, are meant to be exemplary only, and are not meant to limit implementations of the inventions described and/or claimed in this document.

In some embodiments, computing device 800 may include processor 802, memory 804, a storage device 806, a high-speed interface 808 connecting to memory 804 and high-speed expansion ports 810, and a low speed interface 812 connecting to low speed bus 814 and storage device 806. Each of the components 802, 804, 806, 808, 810, and 812, may be interconnected using various busses, and may be mounted on a common motherboard or in other manners as appropriate. The processor 802 can process instructions for execution within the computing device 800, including instructions stored in the memory 804 or on the storage device 806 to display graphical information for a GUI on an external input/output device, such as display 816 coupled to high speed interface 808. In other implementations, multiple processors and/or multiple buses may be used, as appropriate, along with multiple memories and types of memory. Also, multiple computing devices 800 may be connected, with each device providing portions of the necessary operations (e.g., as a server bank, a group of blade servers, or a multi-processor system).

Memory 804 may store information within the computing device 800. In one implementation, the memory 804 may be a volatile memory unit or units. In another implementation, the memory 804 may be a non-volatile memory unit or units. The memory 804 may also be another form of computer-readable medium, such as a magnetic or optical disk.

Storage device 806 may be capable of providing mass storage for the computing device 800. In one implementation, the storage device 806 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 804, the storage device 806, memory on processor 802, or a propagated signal.

High speed controller 808 may manage bandwidth-intensive operations for the computing device 800, while the low speed controller 812 may manage lower bandwidth-intensive operations. Such allocation of functions is exemplary only. In one implementation, the high-speed controller 808 may be coupled to memory 804, display 816 (e.g., through a graphics processor or accelerator), and to high-speed expansion ports 810, which may accept various expansion cards (not shown). In the implementation, low-speed controller 812 is coupled to storage device 806 and low-speed expansion port 814. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

Computing device 800 may be implemented in a number of different forms, as shown in the figure. For example, it may be implemented as a standard server 820, or multiple times in a group of such servers. It may also be implemented as part of a rack server system 824. In addition, it may be implemented in a personal computer such as a laptop computer 822. Alternatively, components from computing device 800 may be combined with other components in a mobile device (not shown), such as device 870. Each of such devices may contain one or more of computing device 800, 870, and an entire system may be made up of multiple computing devices 800, 870 communicating with each other.

Computing device 870 may include a processor 872, memory 864, an input/output device such as a display 874, a communication interface 866, and a transceiver 868, among other components. The device 870 may also be provided with a storage device, such as a microdrive or other device, to provide additional storage. Each of the components 870, 872, 864, 874, 866, and 868, may be interconnected using various buses, and several of the components may be mounted on a common motherboard or in other manners as appropriate.

Processor 872 may execute instructions within the computing device 870, including instructions stored in the memory 864. The processor may be implemented as a chipset of chips that include separate and multiple analog and digital processors. The processor may provide, for example, for coordination of the other components of the device 870, such as control of user interfaces, applications run by device 870, and wireless communication by device 870.

In some embodiments, processor 872 may communicate with a user through control interface 878 and display interface 876 coupled to a display 874. The display 874 may be, for example, a TFT LCD (Thin-Film-Transistor Liquid Crystal Display) or an OLED (Organic Light Emitting Diode) display, or other appropriate display technology. The display interface 876 may comprise appropriate circuitry for driving the display 874 to present graphical and other information to a user. The control interface 878 may receive commands from a user and convert them for submission to the processor 872. In addition, an external interface 862 may be provide in communication with processor 872, so as to enable near area communication of device 870 with other devices. External interface 862 may provide, for example, for wired communication in some implementations, or for wireless communication in other implementations, and multiple interfaces may also be used.

In some embodiments, memory 864 may store information within the computing device 870. The memory 864 can be implemented as one or more of a computer-readable medium or media, a volatile memory unit or units, or a non-volatile memory unit or units. Expansion memory 874 may also be provided and connected to device 870 through expansion interface 872, which may include, for example, a SIMM (Single In Line Memory Module) card interface. Such expansion memory 874 may provide extra storage space for device 870, or may also store applications or other information for device 870. Specifically, expansion memory 874 may include instructions to carry out or supplement the processes described above, and may include secure information also. Thus, for example, expansion memory 874 may be provide as a security module for device 870, and may be programmed with instructions that permit secure use of device 870. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product may contain instructions that, when executed, perform one or more methods, such as those described above. The information carrier may be a computer- or machine-readable medium, such as the memory 864, expansion memory 874, memory on processor 872, or a propagated signal that may be received, for example, over transceiver 868 or external interface 862.

Device 870 may communicate wirelessly through communication interface 866, which may include digital signal processing circuitry where necessary. Communication interface 866 may provide for communications under various modes or protocols, such as GSM voice calls, SMS, EMS, or MMS speech recognition, CDMA, TDMA, PDC, WCDMA, CDMA2000, or GPRS, among others. Such communication may occur, for example, through radio-frequency transceiver 868. In addition, short-range communication may occur, such as using a Bluetooth, WiFi, or other such transceiver (not shown). In addition, GPS (Global Positioning System) receiver module 870 may provide additional navigation- and location-related wireless data to device 870, which may be used as appropriate by applications running on device 870.

Device 870 may also communicate audibly using audio codec 860, which may receive spoken information from a user and convert it to usable digital information. Audio codec 860 may likewise generate audible sound for a user, such as through a speaker, e.g., in a handset of device 870. Such sound may include sound from voice telephone calls, may include recorded sound (e.g., voice messages, music files, etc.) and may also include sound generated by applications operating on device 870.

Computing device 870 may be implemented in a number of different forms, as shown in the figure. For example, it may be implemented as a cellular telephone 880. It may also be implemented as part of a smartphone 882, personal digital assistant, remote control, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

As will be appreciated by one skilled in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present disclosure may be written in an object oriented programming language such as Java, Smalltalk, C++ or the like. However, the computer program code for carrying out operations of the present disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Having thus described the disclosure of the present application in detail and by reference to embodiments thereof, it will be apparent that modifications and variations are possible without departing from the scope of the disclosure defined in the appended claims.

What is claimed is:

1. A computer-implemented method for concatenative speech synthesis comprising:

accessing, using one or more computing devices, a plurality of speech synthesis units from a speech database;

determining a similarity between the plurality of speech synthesis units, wherein determining the similarity is based upon, at least in part, a similarity factor;

retrieving two or more speech synthesis units having the similarity; and pruning at least one of the two or more speech synthesis units based upon, at least in part, the similarity, wherein pruning is based upon, at least in part, a delta unit appearance frequency "DUAF" technique and wherein the DUAF is based upon, at least in part, a change in a unit appearance frequency and a change of the similarity factor.

2. The method of claim 1, wherein the pruning is based upon, at least in part, a delta unit appearance frequency technique and a unit appearance frequency technique.

3. The method of claim 1, further comprising:

receiving a text input corresponding to an utterance during a massive synthesis phase associated with the concatenative speech synthesis.

4. The method of claim 3, further comprising:

determining a unit set based upon, at least in part, the utterance.

5. The method of claim 4, further comprising:

providing the unit set as feedback prior to the pruning.

6. A non-transitory computer-readable storage medium having stored thereon instructions, which when executed by a processor result in one or more concatenative speech synthesis operations, the operations comprising:

accessing, using one or more computing devices, a plurality of speech synthesis units from a speech database;

determining a similarity between the plurality of speech synthesis units, wherein determining the similarity is based upon, at least in part, a similarity factor;

retrieving two or more speech synthesis units having the similarity; and pruning at least one of the two or more speech synthesis units based upon, at least in part, the similarity, wherein pruning is based upon, at least in part, a delta unit appearance frequency "DUAF" technique and wherein the DUAF is based upon, at least in part, a change in a unit appearance frequency and a change of the similarity factor.

7. The non-transitory computer-readable storage medium of claim 6, wherein the pruning is based upon, at least in part, a delta unit appearance frequency technique and a unit appearance frequency technique.

8. The non-transitory computer-readable storage medium of claim 6, further comprising:

receiving a text input corresponding to an utterance during a massive synthesis phase associated with the concatenative speech synthesis.

9. The non-transitory computer-readable storage medium of claim 8, further comprising:

determining a unit set based upon, at least in part, the utterance.

10. The non-transitory computer-readable storage medium of claim 9, further comprising:

providing the unit set as feedback prior to the pruning.

11. A system configured to perform concatenative speech synthesis comprising:

one or more processors configured to access a plurality of speech synthesis units from a speech database and determine a similarity between the plurality of speech synthesis units, wherein determining the similarity is based upon, at least in part, a similarity factor, the one or more processors further configured to retrieve two or more speech synthesis units having the similarity, the one or more processors further configured to prune at least one of the two or more speech synthesis units based upon, at least in part, the similarity, wherein pruning is based upon, at least in part, a delta unit appearance frequency "DUAF" technique and wherein the DUAF is based upon, at least in part, a change in a unit appearance frequency and a change of the similarity factor.

12. The system of claim 11, wherein the pruning is based upon, at least in part, a delta unit appearance frequency technique and a unit appearance frequency technique.

13. The system of claim 11, further comprising:

receiving a text input corresponding to an utterance during a massive synthesis phase associated with the concatenative speech synthesis.

14. The system of claim 13, further comprising:

determining a unit set based upon, at least in part, the utterance; and providing the unit set as feedback prior to the pruning.

* * * * *